US006670884B1

(12) United States Patent
Tett

(10) Patent No.: US 6,670,884 B1
(45) Date of Patent: Dec. 30, 2003

(54) DISPOSABLE WIRELESS MESSAGING DEVICES AND SYSTEMS AND METHODS RELATED TO SAME

(75) Inventor: Richard J. Tett, Plano, TX (US)

(73) Assignee: WebLink Wireless, Inc., Dallas, TX (US)

( * ) Notice: Subject to any disclaimer, the term of this patent is extended or adjusted under 35 U.S.C. 154(b) by 0 days.

(21) Appl. No.: 09/476,640

(22) Filed: Dec. 31, 1999

(51) Int. Cl.[7] ..... G08B 5/22

(52) U.S. Cl. ..... 340/7.1; 340/7.21; 340/7.31; 455/556; 709/230

(58) Field of Search ..... 340/5.21, 7.21, 340/7.29, 7.31, 7.32, 7.33, 7.37, 7.48, 10.1, 10.52, 7.1; 455/466, 412, 522, 556; 709/230, 232; 375/347

(56) References Cited

U.S. PATENT DOCUMENTS 5,758,293 A * 5/1998 Frasier ..... 455/556
5,883,928 A * 3/1999 Eaton ..... 375/347
6,014,705 A * 1/2000 Koenck et al. ..... 709/230
6,044,069 A * 3/2000 Wan ..... 370/311
6,130,916 A * 10/2000 Thomson ..... 375/285
6,282,430 B1 * 8/2001 Young ..... 455/522
6,381,465 B1 * 4/2002 Chern et al. ..... 340/7.21

* cited by examiner

*Primary Examiner*—Van Trieu

(57) ABSTRACT

The teachings of the present invention are directed to disposable wireless messaging devices, computer systems that incorporate disposable wireless messaging devices, and methods of operating the same. An exemplary disposable wireless messaging device includes a housing, a transceiver, a power supply and a messaging controller. The housing is capable of enveloping at least a portion of the messaging controller, and, the transceiver and the power supply. The transceiver is associated with the housing and the messaging controller, and capable of transmitting and receiving signals wirelessly. The messaging controller operates to extract wireless messages from the wirelessly received signals and to communicate the wireless messages to a user of the wireless messaging device. The messaging controller is capable of (i) monitoring use of the disposable wireless messaging device in relation to a utilization threshold and (ii) in response, inhibiting, the operation of at least a portion of the messaging controller.

46 Claims, 7 Drawing Sheets

DISPOSABLE WIRELESS MESSAGING DEVICES AND SYSTEMS AND METHODS RELATED TO SAME

TECHNICAL FIELD OF THE INVENTION

The principles of the present invention are directed generally to wireless communication devices and, more particularly, to disposable wireless messaging devices, computer systems that incorporate disposable wireless messaging devices, and methods of operating the same.

BACKGROUND OF THE INVENTION

The demand for better and cheaper wireless messaging services and equipment continues to grow at a rapid pace. Much of this growth is due to the increase of service types coupled with a decrease in service costs, with users typically renting or buying pagers for use over an extended period of time. However, as costs decrease and services increase, there are increasing demands for messaging services provided for short time durations (i.e., temporary messaging services).

For instance, the day-surgery facilities of hospitals in larger urban areas sometimes provide pagers for temporary use by a patient's family member or friend. This service provides the patient's representative with the freedom to leave the medical facility without the need for continually calling to determine the status of the patient or to determine the exact time for patient pick-up. It can also relieve the patient of concern for undue disruption of their relative's or friend's daily routine and some anxiety associated with getting out of the hospital as soon as possible. Besides providing a feeling of good-will toward the hospital, this service also provides more time for hospital staff to actually serve the patient by decreasing the amount of pressure from waiting family or friends.

In a similar manner, hospitals may provide pagers for temporary use by the husbands of expectant women who otherwise do not require paging services. In these cases, a mother-to-be can page her husband when she is unable to reach him by telephone. If text messaging services are available, she may provide more detailed messages, such as "Meet me at the hospital, now!"

The increased demand for temporary wireless messaging services also creates a need for lower cost pagers to provide these services. Presently, hospitals and other businesses, such as automotive repair shops, may loan or rent pagers to customers. Invariably, providing this type of customer convenience eventually results in increased costs as pagers are lost, damaged, or otherwise not returned to the provider. Furthermore, it may be hard to predict the maximum number of pagers, including back-ups, which must be available for providing the same level of paging service to all potential users.

Improvements in paging services and lower costs allow users to develop new uses for these services, especially temporary uses. For instance, a parent may want to give a two-way pager to a child for a football trip. This would provide the student with an economical means for contacting the parent if a transportation emergency or other type of emergency occurs.

Temporary wireless messaging devices also allows an organization, such as a trade union, to rapidly poll its members during, for example, contract negotiations. If inexpensive, limited capability wireless messaging devices are available, the union can distribute disposable wireless messaging devices to its membership for more or less instantaneous voting. Once negotiations are complete, the union can subsequently transfer a universal disabling message to all distributed wireless messaging devices, thereby disabling the devices and preventing further service charges.

Therefore, there exists a need in the art for an improved wireless communication system that minimizes the equipment costs associated with individual pagers or other types of wireless messaging devices. In particular, there is a need for a low-cost, disposable wireless messaging device that can be used for a short-duration of time or a limited number of transactions.

SUMMARY OF THE INVENTION

To address the above-discussed deficiencies of the prior art, an object of the teachings of the present invention is to provide a disposable wireless messaging device comprising: 1) a receiver capable of receiving signals wirelessly; 2) a messaging controller coupled to the receiver capable of extracting wireless messages from the wirelessly received signals and communicating the wireless messages to a user, wherein the messaging controller is further capable of (i) monitoring use of the disposable wireless messaging device in relation to a utilization threshold, and (ii) inhibiting, in response thereto, the operation of at least a portion of the messaging controller; and 3) a housing that is at least substantially rigid and that is capable of enveloping at least a portion of the messaging controller and the receiver.

According to one embodiment of the present invention, the messaging controller is further capable of controlling power consumption of the disposable wireless messaging device.

According to another embodiment of the present invention, the disposable wireless messaging device further comprises a power supply for supplying power to the disposable wireless messaging device.

According to still another embodiment of the present invention, the messaging controller inhibits the operation by controlling the power supply.

According to yet another embodiment of the present invention, the disposable wireless messaging device further comprises a power controller that is capable of increasing a voltage from a power supply to the messaging controller in response to a triggering event.

According to a further embodiment of the present invention, the disposable wireless messaging device further comprises means, having an output signal corresponding to the triggering event, for selectively enabling the power controller.

According to a still further embodiment of the present invention, the messaging controller is further capable, in response to the power supply voltage being initially increased to the messaging controller, of performing diagnostics on at least a portion of the disposable wireless messaging device.

According to a yet further embodiment of the present invention, the messaging controller is further capable, in response to the diagnostics completion, of inhibiting the selectively enabling means.

In one embodiment of the present invention, the messaging controller is further capable, in response to the power supply voltage being increased to the messaging controller, of inhibiting the selectively enabling means upon one of an undesirable comparison among the monitored use and the utilization threshold and an expiration of a time period.

In another embodiment of the present invention, the disposable wireless messaging device further comprises means, associated with the messaging controller, for communicating the wireless messages to a user.

In still another embodiment of the present invention, the disposable wireless messaging device further comprises a transmitter that is associated with the housing and the messaging controller, and that is capable of transmitting signals wirelessly.

In yet another embodiment of the present invention, the receiver and the transmitter are integrated into a transceiver that is capable of receiving and transmitting signals wirelessly.

In a further embodiment of the present invention, the messaging controller is responsive to a received control message to modify the monitored use of the disposable wireless messaging device as related to the utilization threshold.

In a still further embodiment of the present invention, the housing is adapted for association with a computer system.

In a yet further embodiment of the present invention, the messaging controller is capable of tracking a quantity of wireless messages extracted from the wirelessly received signals.

In another embodiment of the present invention, the messaging controller is capable of determining whether a particular wireless message is received more than once.

In still another embodiment of the present invention, the messaging controller is further capable of inhibiting operation of at least one of (i) the receiver, (ii) the messaging controller, and (iii) the power supply.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the DETAILED DESCRIPTION, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
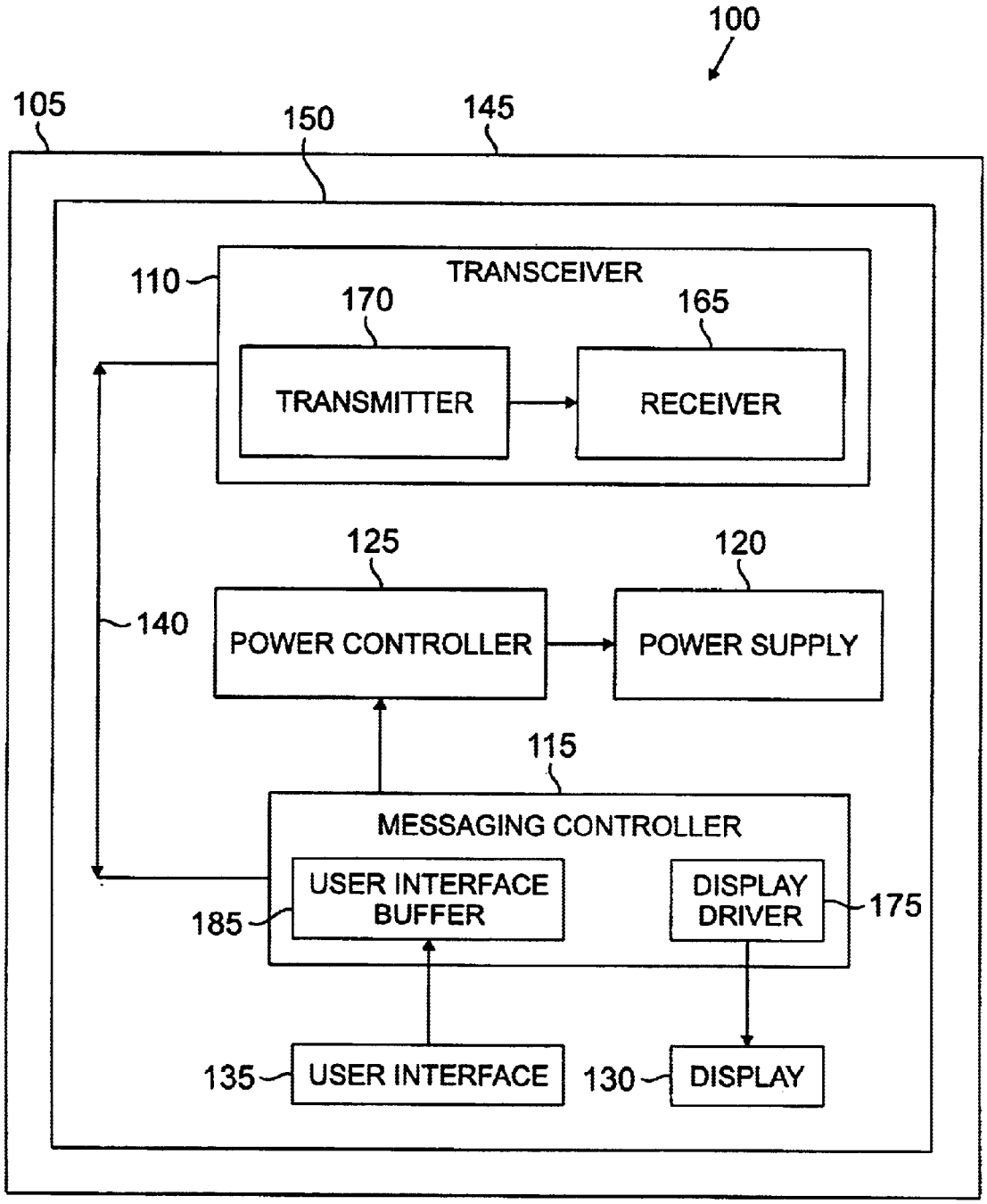
FIG. 1 illustrates a block diagram of an exemplary disposable wireless messaging device in accordance with the principles of the present invention.

Turning initially to FIG. 1, illustrated is a functional block diagram of exemplary disposable wireless messaging device (generally designated 100) in accordance with the principles of the present invention. Exemplary disposable wireless messaging device 100 illustratively includes housing 105, transceiver 110, messaging controller 115, power supply 120, power controller 125, display 130, and user interface 135, all of which are illustratively and suitably associated by bus 140.

According to the illustrated embodiment, exemplary housing 105 is adapted to envelop transceiver 110, messaging controller 115, power supply 120, and power controller 125, and to partially envelop display 130 and user interface 135. The term "envelop" and derivatives thereof, as used herein, are defined broadly to mean enclose, blanket, surround, encompass, contain, encase, encircle, insulate, package, shield, shelter, safeguard, or the like.

Housing 105 is preferably at least substantially rigid. This desired feature meets two primary objects of housing 105, namely, (i) to provide protection for the above-identified components and (ii) to provide, in embodiments in which disposable wireless messaging device 100 is associated with a computer system (an exemplary embodiment is discussed with reference to FIGS. 3 and 4), a physical adaption that enables a cooperation among disposable wireless messaging device 100 and the computer system. Housing 105 may, for instance, be fabricated from an impact resistant cardboard, or, alternatively, housing 105 may, as another example, be fabricated from a plastic, such as a highly impact resistant injection polymer.

Housing 105 includes outer layer 145 and inner layer 150. Exemplary outer layer 145 is a shock-resistant material, that minimizes the shock from external forces. Housing 105 may be constructed in multiple parts (not shown) that are preferably secured together during assembly to form housing 105. The multiple housing parts may suitably be secured together with recessed screws or adjoining members that may be bonded, snap-fit, interference fit or the like, in reciprocating recesses in the respective parts. Housing 105 includes an illustrative elongated attachment member that can be used to associate disposable wireless messaging device 100 with a computer system. Housing 105 includes a cavity or aperture for display 130 and for user interface 135.

Exemplary transceiver 110 is associated with housing 105 and messaging controller 115, and includes receiver 165 and transmitter 170 that respectively receive and transmit signals wirelessly. In certain one-way messaging embodiments of the present invention, disposable wireless messaging device 100 may include only receiver 165 for receiving signals wirelessly. In other one-way messaging embodiments, disposable wireless messaging device 100 may include only transmitter 170 for transmitting signals wirelessly.

Exemplary messaging controller 115 operates to extract wireless messages from the wirelessly received signals and to communicate the wireless messages to a user via display 130. Messaging controller 115 is capable, in accord with the principles of the present invention, (i) to monitor use of disposable wireless messaging device 100 in relation to a utilization threshold, and (ii) to inhibit, in response thereto, the operation of at least a portion of its own operation (at least a portion of the operation of messaging controller 115).

Exemplary power supply 120 provides power to disposable wireless messaging device 100. Exemplary power controller 125, which is illustratively associated with power supply 120 and messaging controller 115, controls power consumption by disposable wireless messaging device 100. According to the illustrated embodiment, power controller 125 is capable of increasing, maintaining and decreasing a voltage from power supply 120 to messaging controller 115. According to an advantageous embodiment, power supply 120 is a limited-life battery that provides power, once enabled. In an alternate embodiment, power supply 120 may suitably be charged or re-charged. According to one embodiment, power supply 120 includes conventional light sensing panels that enable power supply 120 to generate power via a sensed light source and to store the generated power in, and supply power from, the battery.

In short, power supply 120 may suitably be any appropriate means for supplying power to disposable wireless messaging device 100, whether that source of direct current, or otherwise. For instance, using the integrated disposable wireless messaging device 100 and computer embodiment, power may be delivered directly from the computer to disposable wireless messaging device 100.

Exemplary display 130 operates to present a visual display of data. As stated above, messaging controller 115 extracts wireless messages from the wirelessly received signals. Messaging controller 115 includes display driver 175 that communicates the wireless messages to the user via display 130. Display 130 and display driver 175 provide an exemplary interface, associated with messaging controller 115, for communicating the wireless messages to a user. Alternate interfaces may include audio systems, braille systems, other video systems, combinations of these components, and the like.

Exemplary user interface 135 is associated with messaging controller 115 and is operative to enable the user to interact with disposable wireless messaging device 100 and, more particularly, messaging controller 115. In general, use of user interfaces with messaging controller 115 and, more broadly, with wireless messaging devices is known.

Figure 2:
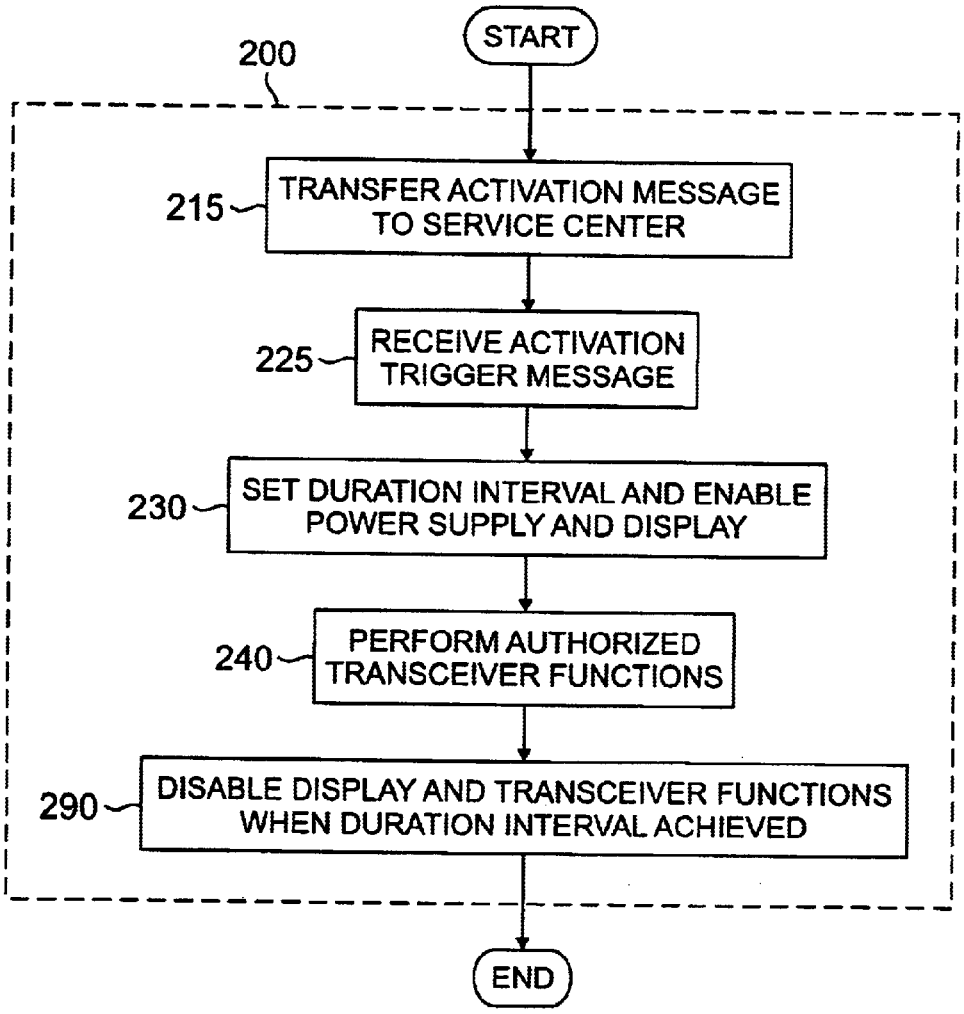
FIG. 2 illustrates a flow diagram of an exemplary method of operating the disposable wireless messaging device of FIG. 1 in accordance with the principles of the present invention.

Turning next to FIG. 2, illustrated is a flow diagram of an exemplary method (generally designated 200) of operating disposable wireless messaging device 100 in accordance with the principles of the present invention. For purposes of illustration, concurrent reference is made to FIG. 1 during the discussion hereof.

To begin, disposable wireless messaging device 100 detects that a user has requested the initiation of wireless service by depressing a button, such as an ENTER button, at user interface 135. Subsequently, disposable wireless messaging device 100 transmits an activation message that is designated for a remote service center (process step 215). At some later time, receiver 165 associated with disposable wireless messaging device 100 receives an activation message from the remote service center with its designation code and transfers this signal to messaging controller 115. Messaging controller 115 decodes the received message as an activation trigger message (process step 225).

Messaging controller 115 starts an interval timer and generates an enabling signal for power controller 125. Power controller 125 detects the presence of the enabling signal and enables output power for display driver 175 and display 130 (process step 230). In one embodiment, an activation display (such as "****") is enabled by messaging controller 115 through display driver 175** as an indication that the disposable wireless messaging device has been activated for full service capability.

Once activated for full service, disposable wireless messaging device 100 receives and displays designated wireless messages and transmits messages input through user interface 135 as authorized for the designated level of service (process step 240).

Disposable wireless messaging device 100 continues to provide authorized transceiver functions until messaging controller 115 or power controller 125 detects that the activation interval for the service has been achieved. This activation interval may be equivalent to an elapsed amount of time or to a limited number of displayed messages or to a limited number of transmitted messages or some combination of the above. In the simplest of embodiments, messaging controller 115 may detect that an END SERVICE message has been received as an indication that the service interval is over. Working together, messaging controller 115 and power controller 125 disable the transceiver function by, for instance, removing power from display 130 and disabling entry of new information through user interface 135 (process step 290).

At the point of de-activation and depending upon the configuration of disposable wireless messaging device 100, the user may discard the device or return it to a service center for re-cycling. Re-cycling services may range from permanent disposal through re-activation for service by the same or different user.

Figure 3:
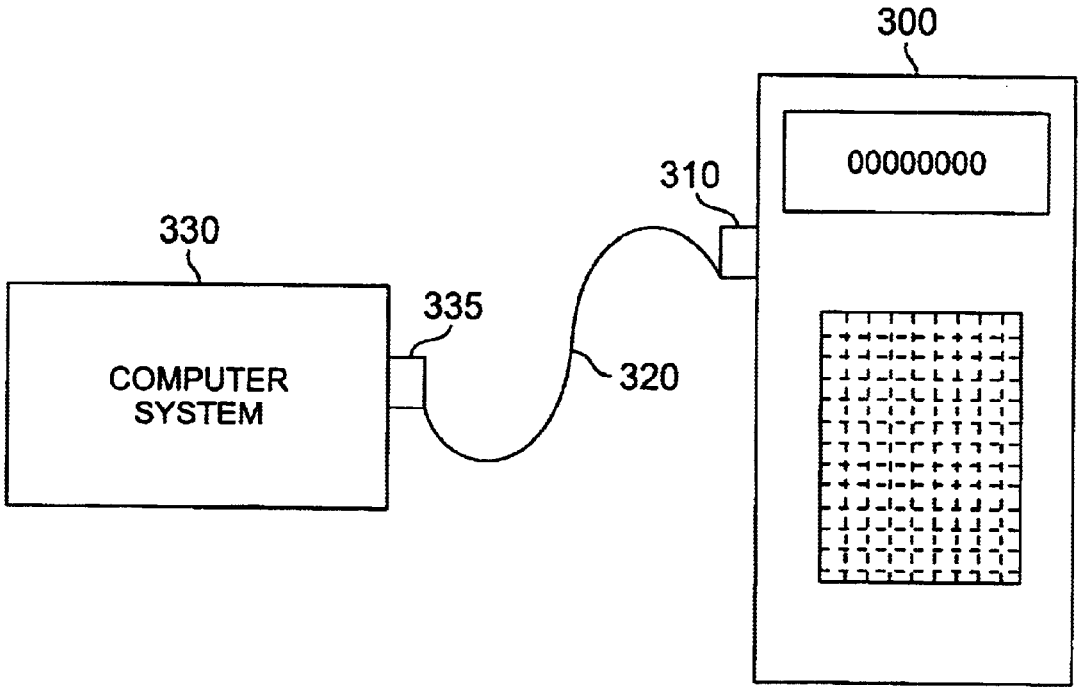
FIG. 3 illustrates a system diagram of an exemplary disposable wireless messaging device interfaced with a computer system.

Turning next to FIG. 3, illustrated is a high level block diagram showing disposable wireless messaging device 300, including mating connector 310, interconnected through cable 320 to computer system 330 at computer mating connectors 335. For this embodiment, disposable wireless messaging device 300 provides the same function as disposable wireless messaging device 100, with inclusion for mating connector 310. Mating connector 310 provides an interface to computer system 330 through cable 320. Connectors 310 and 335 and cable 320 are compatible with present art peripheral interfaces with a standard off-the-shelf personal computer (PC) or similar control device. Computer system 330 with connector 335 represents a present art PC or similar device and interconnecting cable 320.

For this exemplary embodiment, disposable wireless messaging device 300 transfers an activation request to computer system 330. In turn, computer system 330 may transfer a unique paging address plus activation signal to disposable wireless messaging device 300. Subsequently, disposable wireless messaging device 300 receives and stores its assigned address in messaging controller 115. Disposable wireless messaging device 300 then receives an activation signal from computer system 330. Messaging controller 115 stores and decodes the received activation signal and uses it to enable operation for the specified duration interval. As previously described, the duration interval may have one or more determining characteristics such as number of messages received, number of message transmitted, length of operation time, battery supply time, etc.

Figure 4:
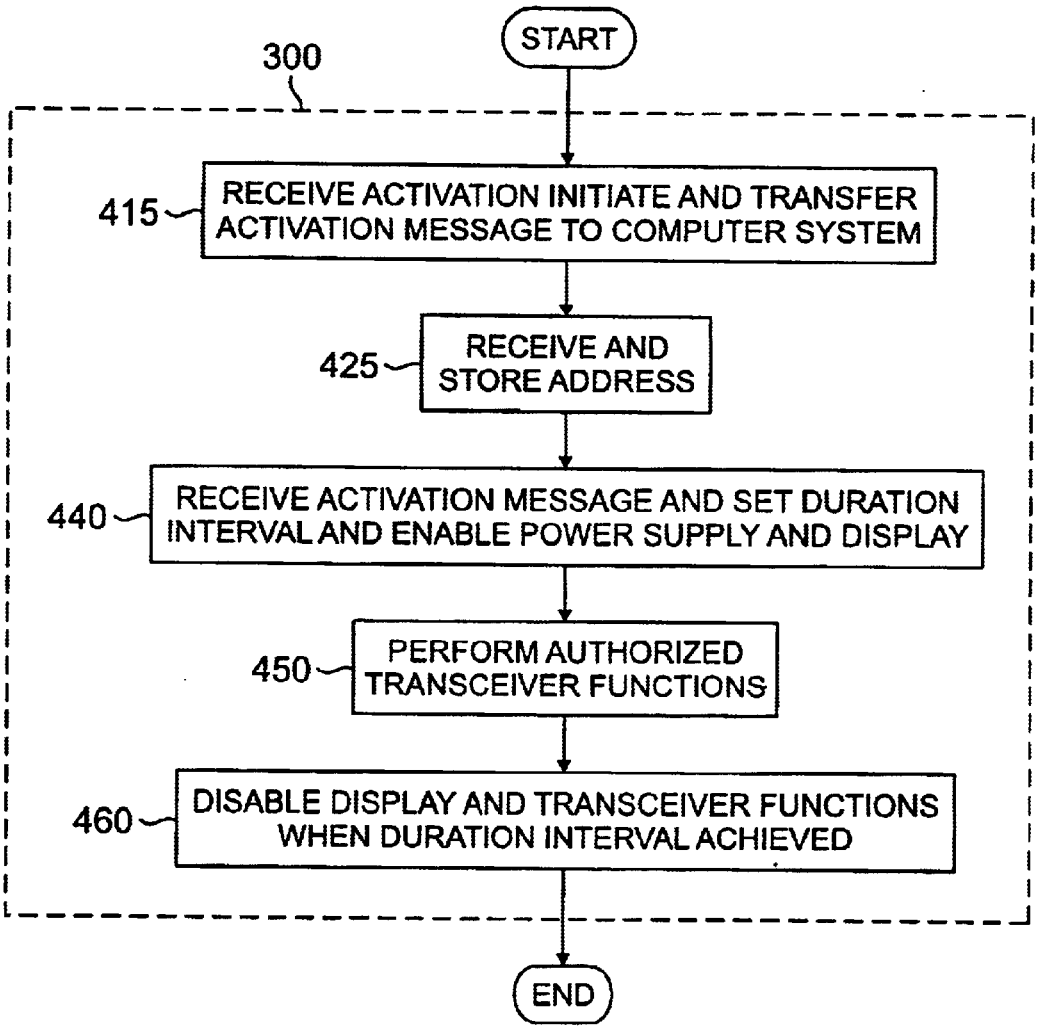
FIG. 4 illustrates a flow diagram of an exemplary method of operating the disposable wireless messaging device of FIG. 3 in accordance with the principles of the present invention.

FIG. 4 provides a high level exemplary flow diagram showing the operation of disposable wireless messaging device 300. When the activation key is depressed at user interface 135, disposable wireless messaging device 300 transfers an activation request to interfacing computer system 330 (process step 415). When the address message is transferred by computer system 330, disposable wireless messaging device 300 receives and stores the address message and enables the stored address as the address assigned for inclusion with all wireless communications to and from itself (process step 425). Disposable wireless messaging device 300 then receives the activation message from computer system 330. Disposable wireless messaging device 300 sets the duration interval and enables power supply 120 and display 130 as indicated by the content of the received activation message (process step 440). Once activated, disposable wireless messaging device 300 performs authorized wireless transceiver functions (process step 450). When wireless messaging device 300 determines that the designated duration interval has been satisfied, it disables operation as specified by the prior activation message (process step 460). Depending upon the particular implementation, wireless messaging device 300 may permanently disable itself (self-destruct) so that it cannot be activated again or it may place itself in an idle mode until again activated by computer instruction or other available means.

Figure 5:
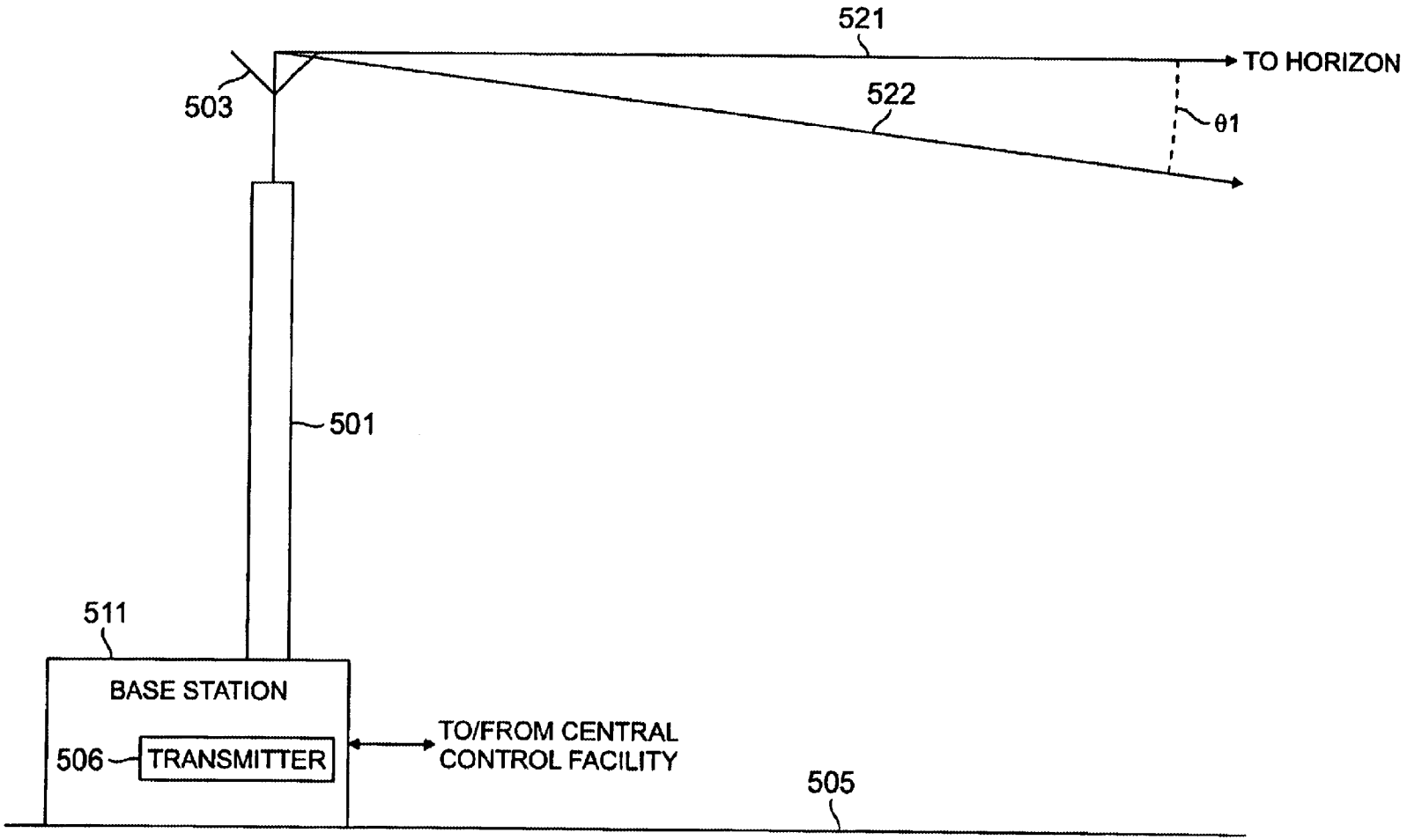
FIG. 5 (PRIOR ART)
FIG. 5 illustrates a base station which uses conventional techniques to communicate in forward channels with exemplary disposable wireless messaging devices.

FIG. 5 illustrates base station 511, which uses conventional techniques to communicate in forward channels with exemplary disposable wireless messaging devices. One-way wireless messaging systems typically employ electrical "downtilt" in the antennas associated with base stations in order to reduce the effective range of the forward-channel signals. The forward-channel represents the transmission channel of the base station and the receive channel of the exemplary disposable wireless messaging device.

Base station 511 comprises tower 501 for holding antenna 503 in an elevated position above ground 505. Base station 511 comprises transmitter 506 for transmitting messages in the forward-channel. The forward-channel is transmitted to disposable wireless messaging devices (not shown) and the forward-channel and control messages are appropriately transferred to and from a central control facility (not shown).

Reference beam 521 is a horizontal reference axis indicating the relative position of the horizon. Antenna 503 employs electrical downtilt to transmit messages in the forward-channel along beam 522. Beam 522 represents the direction of travel with respect to the horizon of the main power lobe transmitted by antenna 503. As FIG. 5 indicates, beam 522 is transmitted below the horizon at a downtilt angle, θ1, for reception by any compatible disposable wireless messaging units of the present invention which are in its path. The downtilt angle θ1 is determined by the electrical characteristics of antenna 503 and is dependent on the transmission frequency of the forward-channel. Disposable wireless messaging devices of the present invention are configured to receive one or more frequencies of the forward-channel with the specific receive operating frequency being fixed or computer defined or remotely programmed through the disposable wireless messaging device's control channel.

The primary purpose in employing electrical downtilt in beam 522 is to restrict the size of the coverage area for the indicated base station. If forward-channel beam 522 is oriented directly toward the horizon with no electrical downtilt, much of the energy of the signal transmitted by antenna 503 would be transmitted to infinity, and therefore lost. Since the one-way embodiment of disposable wireless messaging devices provides no means for the disposable wireless messaging devices to transmit information to base station 511, base station 511 and the broader messaging system have no means for determining the geographical location of any specific disposable wireless messaging device.

Figure 6:
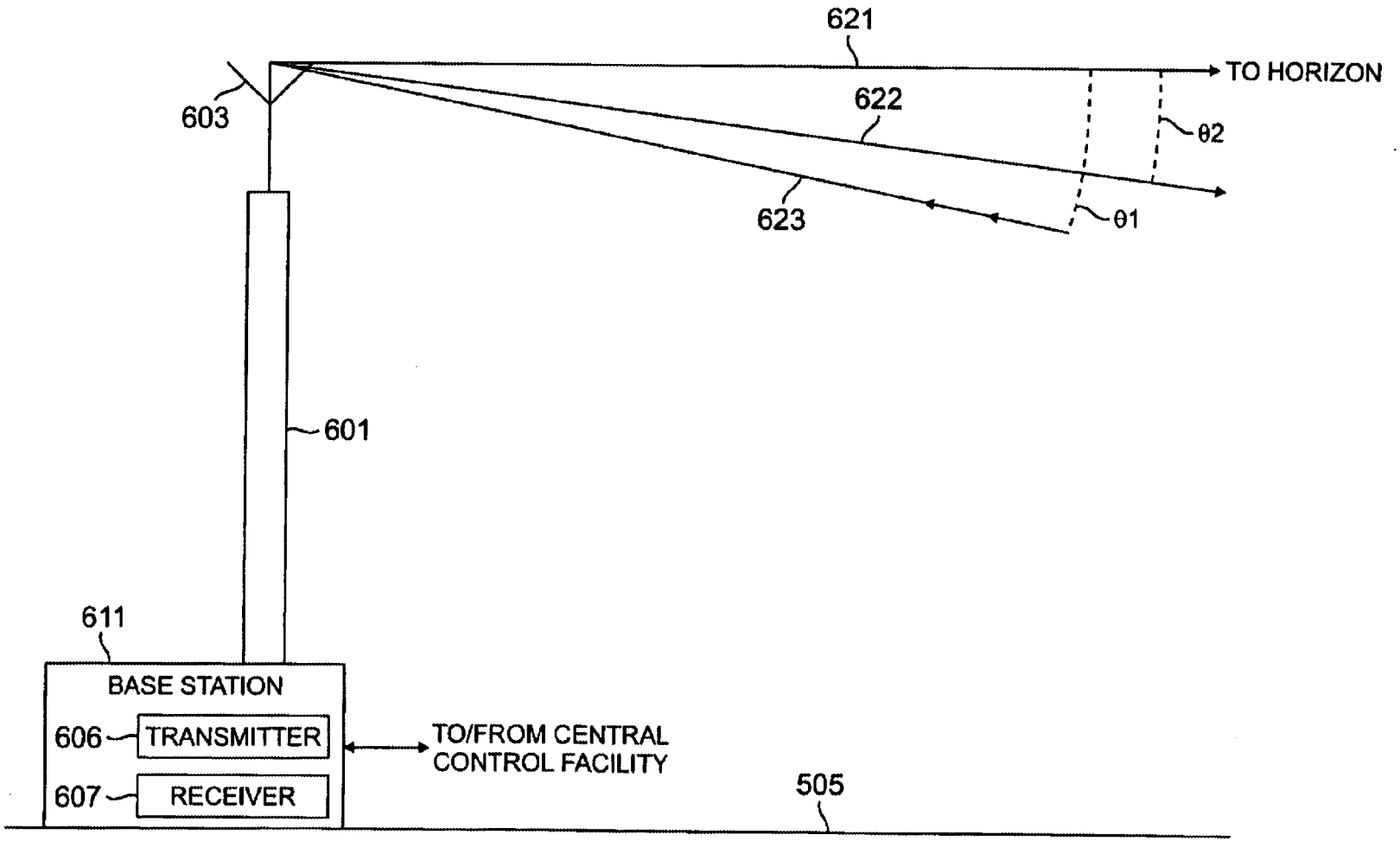
FIG. 6 (PRIOR ART)
FIG. 6 illustrates a base station which uses conventional techniques to communicate in forward and reverse channels with exemplary disposable wireless messaging devices.

FIG. 6 illustrates base station 611, which uses conventional techniques to communicate in forward and reverse channels with exemplary disposable wireless messaging devices. Prior art two-way wireless messaging systems, such as two-way paging systems, typically employ previously described electrical "downtilt" in the antennas associated with the base stations in order to reduce the effective range of forward-channel signals and to attenuate reverse-channel signals received from distant wireless messaging units or other base stations. Although the discussion that follows of prior art electrical downtilt techniques centers on base station 611, it should be noted that this is by way of illustration only, and that the following discussion applies with equal force to the other base stations in a messaging network.

Base station 611 comprises tower 601 for holding antenna 603 in an elevated position above ground 505. Base station 611 also comprises transmitter 606 for transmitting messages in the forward-channel and receiver 607 for receiving messages in the reverse-channel. The forward and reverse-channel messages are transferred to and from disposable wireless messaging devices (not shown) and a central control facility (not shown).

Reference beam 621 is a horizontal reference axis indicating the relative position of the horizon. Antenna 603 employs electrical downtilt to transmit messages in the forward-channel along beam 622. Beam 622 represents the direction of travel with respect to the horizon of the main power lobe transmitted by antenna 603. As FIG. 6 indicates, beam 622 is transmitted below the horizon at a downtilt angle, θ1, for reception by any compatible disposable wireless messaging units of the present invention. The downtilt angle θ1 is determined by the electrical characteristics of antenna 603 and is dependent on the transmission frequency of the forward-channel. Disposable wireless messaging devices of the present invention are configured to receive one or more frequencies of the forward-channel with the specific receive operating frequency being fixed, computer defined, or remotely programmed through the disposable wireless messaging device's control channel.

Antenna 603 employs electrical downtilt to receive messages in the reverse-channel along beam 623. Beam 623 represents the direction of travel with respect to the horizon of an incident signal transmitted from an exemplary disposable wireless messaging device located an optimum distance away from antenna 603. The downtilt angle, θ2, of beam 623 is below the horizon and is also below the downtilt angle, θ1, of the beam 622.

The primary purpose in employing electrical downtilt in beam 622 is to restrict the size of the coverage areas for the indicated base station, as previously described for FIG. 5. Furthermore, employing only a small angle of electrical downtilt would direct the main power lobe of forward-channel beam 622 toward very distant disposable wireless messaging devices in other coverage areas, resulting in weak forward-channel messages being received by the distant exemplary disposable wireless messaging devices.

Electrical downtilt in the forward-channel sends a stronger signal to relatively near disposable wireless messaging devices located at the optimum distance from antenna 603 (closer to the perimeter of the coverage area), while minimizing the interfering forward-channel signal sent to relatively remote disposable wireless messaging devices.

Similarly, employing electrical downtilt in beam 623 enables antenna 603 to amplify reverse-channel signals from nearby disposable wireless messaging devices, while attenuating reverse-channel signals from more distant disposable wireless messaging devices.

Figure 7:
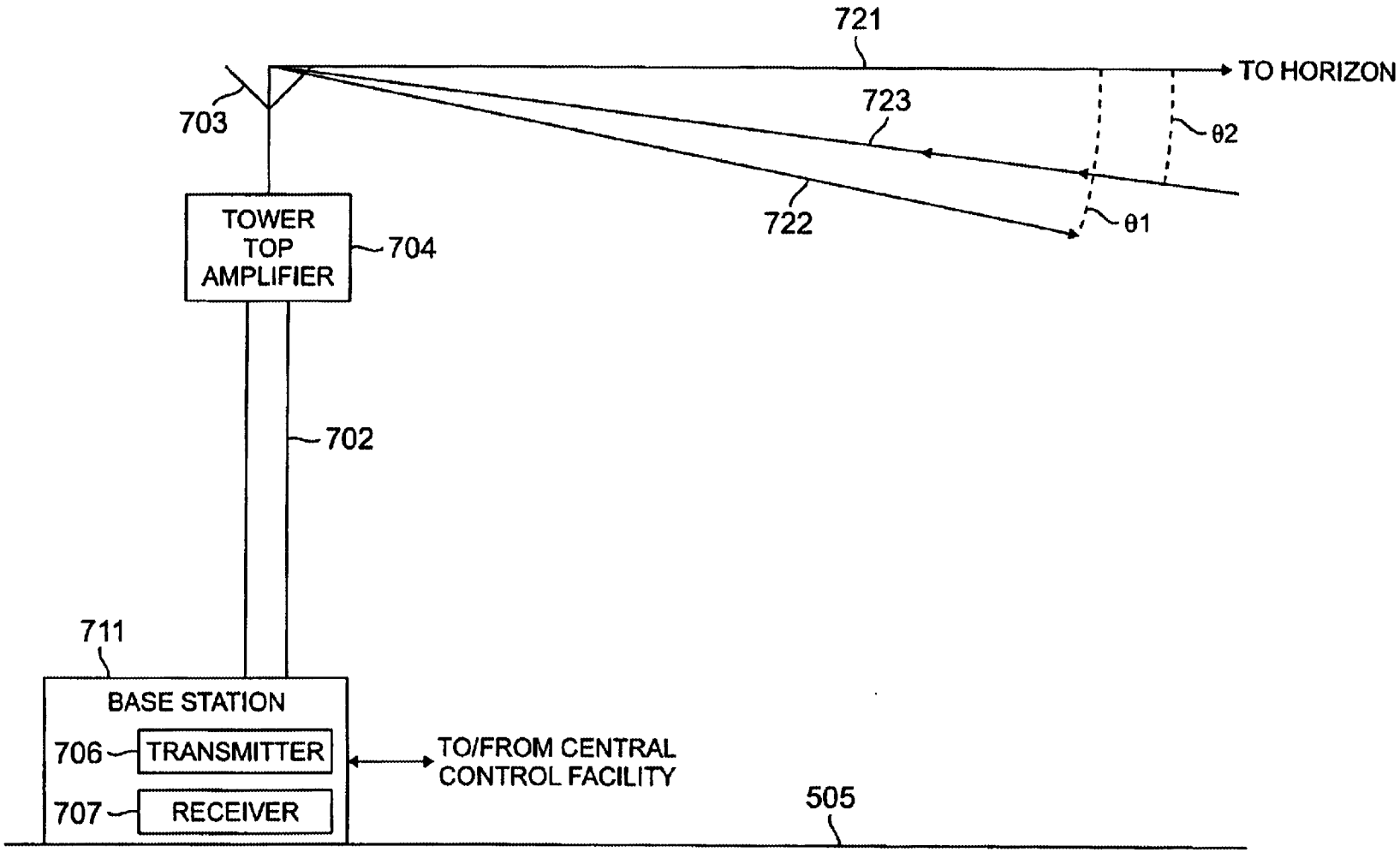
FIG. 7 illustrates a base station which communicates in forward and reverse channels with exemplary disposable wireless messaging devices using electrical downtilt techniques disclosed in U.S. patent application Ser. No. 09/002,191.

FIG. 7 illustrates base station 711, which communicates in forward and reverse channels with exemplary disposable wireless messaging devices using electrical downtilt techniques disclosed in U.S. patent application Ser. No. 09/002,191. The base station 711 comprises tower 702 for holding antenna 703 in an elevated position above ground 505. The base station 711 also comprises transmitter 706 for transmitting messages in the forward-channel to disposable wireless messaging devices and receiver 707 for receiving messages in the reverse-channel from disposable wireless messaging devices. The forward and reverse-channel messages are also appropriately transferred to or from a central control facility (not shown). Tower-top amplifier 704 may optionally be included to strengthen received signals from antenna 703 before relaying the received signals to receiver 707, in order to compensate for line losses occurring on long cables between antenna 703 and receiver 707.

Reference beam 721 is a horizontal reference axis indicating the relative position of the horizon. Antenna 703 employs electrical downtilt to transmit messages in the forward-channel along beam 722 to disposable wireless messaging units. Beam 722 represents the direction of travel with respect to the horizon of the main power lobe transmitted by antenna 703. As FIG. 7 indicates, beam 722 is transmitted below the horizon by antenna 703 at a downtilt angle, θ1. The downtilt angle, θ1, is determined by the electrical characteristics of antenna 703 and is dependent on the transmission frequency of the forward-channel. Disposable wireless messaging devices of the present invention are configured to receive one or more frequencies of the forward-channel with the specific receive operating frequency being fixed, computer defined, or remotely programmed through the disposable wireless messaging device's control channel.

Antenna 703 employs electrical downtilt to receive messages from disposable wireless messaging devices in the reverse-channel along beam 723. The downtilt angle, θ2, is dependent on the transmission frequency of the disposable wireless messaging device and on the electrical characteristics of antenna 703. Beam 723 represents the direction of travel with respect to the horizon of an incident signal transmitted from a disposable wireless messaging device located an optimum distance away from antenna 703.

However, unlike the system of FIG. 6, the downtilt angle, θ2, of reverse-channel (beam 723) is now above the downtilt angle, θ1, of the forward-channel (beam 722). The use of a smaller angle of electrical downtilt in the reverse-channel focuses antenna 703 on signals from more distant paging units, including those beyond the boundaries of the coverage area in which base station 711 resides. The availability of disposable wireless messaging devices that are compliant with this type of system optimization increases the probability that antenna 703 will receive reverse-channel signals from remote messaging units, including disposable wireless messaging devices, in other coverage areas, thereby increasing the overall macro-diversity of messaging network and decreasing the number of additional required receivers.

Although the present invention has been described in detail, those skilled in the art should understand that they can make various changes, substitutions and alterations herein without departing from the spirit and scope of the invention in its broadest form.

What is claimed is:

1. A disposable wireless messaging device, comprising:

a receiver capable of receiving signals wirelessly;

a messaging controller coupled to said receiver capable of extracting wireless messages from said wirelessly received signals and communicating said wireless messages to a user, wherein said messaging controller is further capable of (I) monitoring use of said disposable wireless messaging device in relation to a utilization threshold, and (ii) inhibiting, in response thereto, said operation of at least a portion of said messaging controller;

an interface operable to enable a user to interact with said disposable wireless messaging device; and a housing that is at least substantially rigid and that is capable of enveloping at least a portion of said messaging controller and said receiver.

2. The disposable wireless messaging device recited in claim 1 wherein said messaging controller is further capable of controlling power consumption of said disposable wireless messaging device.

3. The disposable wireless messaging device recited in claim 1 further comprising a power supply for supplying power to said disposable wireless messaging device.

4. The disposable wireless messaging device recited in claim 3 wherein said messaging controller inhibits said operation by controlling said power supply.

5. The disposable wireless messaging device recited in claim 3 wherein said messaging controller is further capable of inhibiting operation of at least one of (I) said receiver, (ii) said messaging controller, and (iii) said power supply.

6. The disposable wireless messaging device recited in claim 1 further comprising a power controller that is capable of increasing a voltage from a power supply to said messaging controller in response to a triggering event.

7. The disposable wireless messaging device recited in claim 6 further comprising means, having an output signal corresponding to said triggering event, for selectively enabling said power controller.

8. The disposable wireless messaging device recited in claim 7 wherein said messaging controller is further capable, in response to said power supply voltage being initially increased to said messaging controller, of performing diagnostics on at least a portion of said disposable wireless messaging device.

9. The disposable wireless messaging device recited in claim 8 wherein said messaging controller is further capable, in response to said diagnostics completion, of inhibiting said selectively enabling means.

10. The disposable wireless messaging device recited in claim 7 wherein said messaging controller is further capable, in response to said power supply voltage being increased to said messaging controller, of inhibiting said selectively enabling means upon one of an undesirable comparison among said monitored use and said utilization threshold and an expiration of a time period.

11. The disposable wireless messaging device recited in claim 1 further including means, associated with said messaging controller, for communicating said wireless messages to a user.

12. The disposable wireless messaging device recited in claim 1 further comprising a transmitter that is associated with said housing and said messaging controller, and that is capable of transmitting signals wirelessly.

13. The disposable wireless messaging device recited in claim 12 wherein said receiver and said transmitter are integrated into a transceiver that is capable of receiving and transmitting signals wirelessly.

14. The disposable wireless messaging device recited in claim 1 further comprising a user interface.

15. The disposable wireless messaging device recited in claim 1 wherein said messaging controller is responsive to a received control message to modify said monitored use of said disposable wireless messaging device as related to said utilization threshold.

16. The disposable wireless messaging device recited in claim 1 wherein said housing is adapted for association with a computer system.

17. The disposable wireless messaging device recited in claim 1 wherein said messaging controller is capable of tracking a quantity of wireless messages extracted from said wirelessly received signals.

18. The disposable wireless messaging device recited in claim 17 wherein said messaging controller is capable of determining whether a particular wireless message is received more than once.

19. A method of operating a disposable wireless messaging device having a housing that is at least substantially rigid and that is capable of enveloping at least a portion of a messaging controller, said method of operation comprising the steps of:

receiving signals wirelessly with a receiver, said receiver associated with said housing and said messaging controller;

extracting wireless messages from said wirelessly received signals with said messaging controller, and communicating said wireless messages through an interface associated with said disposable wireless messaging device to a user of said disposable wireless messaging device;

monitoring use of said disposable wireless messaging device in relation to a utilization threshold with said messaging controller, and inhibiting, in response thereto, said operation of at least a portion of said messaging controller.

20. The method of operation set forth in claim 19 further comprising the step of controlling power consumption of said disposable wireless messaging device with said messaging controller.

21. The method of operation set forth in claim 19 further comprising the step of supplying power to said disposable wireless messaging device with a power supply.

22. The method of operation set forth in claim 21 further comprising the step of controlling said power supply to inhibit said operation of at least said portion of said messaging controller.

23. The method of operation set forth in claim 21 further comprising the step of inhibiting operation of at least one of (I) said receiver, (ii) said messaging controller, and (iii) said power supply.

24. The method of operation set forth in claim 19 further comprising the step of increasing, in response to a triggering event, a voltage from a power supply to said messaging controller using a power controller.

25. The method of operation set forth in claim 24 further comprising the step of selectively enabling said power controller.

26. The method of operation set forth in claim 25 further comprising the step of performing diagnostics on at least a portion of said disposable wireless messaging device in response to said power supply voltage being initially increased to said messaging controller.

27. The method of operation set forth in claim 26 further comprising the step of inhibiting said power controller in response to said diagnostics completion.

28. The method of operation set forth in claim 25 further comprising the step of inhibiting said power controller upon one of an undesirable comparison among said monitored use and said utilization threshold and the expiration of a time period.

29. The method of operation set forth in claim 19 further comprising the step of communicating said wireless messages to a user.

30. The method of operation set forth in claim 19 further comprising the step of transmitting signals wirelessly with a transmitter, said transmitter associated with said housing and said messaging controller.

31. The method of operation set forth in claim 19 further comprising the step of communicating with said user with a user interface.

32. The method of operation set forth in claim 19 further comprising the step of modifying, in response to a received control message to, said monitored use of said disposable wireless messaging device as related to said utilization threshold.

33. The method of operation set forth in claim 19 further comprising the steps of:

associating said housing with a computer system; and establishing a communications channel among said wireless messaging device and said computer system.

34. The method of operation set forth in claim 19 further comprising the step of tracking a quantity of wireless messages extracted from said wirelessly received signals with said messaging controller.

35. The method of operation set forth in claim 34 further comprising the step of determining whether a particular wireless message is received more than once.

36. A computer system comprising:

a memory that is capable of storing a plurality of tasks and data;

a user interface;

a processor that is associated with said memory and said user interface, and that is capable of selectively processing ones of said plurality of tasks and said data; and a disposable wireless messaging device, having a housing that is at least substantially rigid and adapted for association with said computer system, and that is capable of enveloping at least a portion of a messaging controller, said disposable wireless messaging device comprising:

a receiver that is associated with said housing and said messaging controller, and that is capable of receiving signals wirelessly; and said messaging controller that operates to extract wireless messages from said wirelessly received signals and to communicate said wireless messages to a user via said user interface, and that is capable of (I) monitoring use of said disposable wireless messaging device in relation to a utilization threshold and (ii) inhibiting, in response thereto, said operation of at least a portion of said messaging controller.

37. The computer system recited in claim 36 wherein said messaging controller is further capable of controlling power consumption of said disposable wireless messaging device.

38. The computer system recited in claim 37 wherein said messaging controller is further capable of inhibiting operation of at least one of (I) said receiver, (ii) said messaging controller, and (iii) said power supplying means.

39. The computer system recited in claim 36 wherein said messaging controller inhibits said operation by controlling said power supplying means.

40. The computer system recited in claim 36 further comprising a power controller that is capable of increasing a voltage from a power supply to said messaging controller in response to a triggering event.

41. The computer system recited in claim 40 further comprising means, having an output signal corresponding to said triggering event, for selectively enabling said power controller.

42. The computer system recited in claim 41 wherein said messaging controller is further capable, in response to said power supply voltage of being increased to said messaging controller, of inhibiting said selectively enabling means upon one of an undesirable comparison among said monitored use and said utilization threshold and the expiration of a time period.

43. The computer system recited in claim 36 further comprising a transmitter that is associated with said housing and said messaging controller, and that is capable of transmitting signals wirelessly.

44. The computer system recited in claim 36 wherein said messaging controller is responsive to a received control message from said processor to modify said monitored use of said disposable wireless messaging device as related to said utilization threshold.

45. The computer system recited in claim 36 wherein said messaging controller is capable of tracking a quantity of wireless messages extracted from said wirelessly received signals.

46. The computer system recited in claim 45 wherein said messaging controller is capable of determining whether a particular wireless message is received more than once.

* * * * *